United States Patent [19]

Roach

[11] Patent Number: 4,831,915

[45] Date of Patent: May 23, 1989

[54] DUAL DIAPHRAGM THREE POSITION ACTUATOR

[75] Inventor: Jack R. Roach, Florence, S.C.

[73] Assignee: Maremont Corporation, Carol Stream, Ill.

[21] Appl. No.: 220,928

[22] Filed: Jul. 15, 1988

Related U.S. Application Data

[63] Continuation of Ser. No. 941,986, Dec. 15, 1986, abandoned.

[51] Int. Cl.[4] ..... F01B 19/00

[52] U.S. Cl. ..... 92/49; 92/50

[58] Field of Search ..... 92/48, 49, 50; 91/167 R

[56] References Cited

U.S. PATENT DOCUMENTS

| | | | |
|---|---|---|---|
| 3,048,361 | 8/1962 | Francis | 92/50 |
| 3,433,132 | 3/1969 | James | 92/48 |
| 3,683,753 | 8/1972 | Johnson | 92/48 |
| 3,824,903 | 7/1974 | Hahn | 92/48 |
| 4,098,459 | 7/1978 | Benjamin | 92/48 |
| 4,147,094 | 4/1979 | Iguchi | 92/49 |
| 4,612,847 | 9/1986 | Bouvot et al. | 92/13.1 |
| 4,638,723 | 1/1987 | Bouvot | 92/48 |

*Primary Examiner*—Edward K. Look

*Attorney, Agent, or Firm*—McAndrews, Held & Malloy, Ltd.

[57] ABSTRACT

A dual diaphragm, multiposition vacuum actuator. Dual diaphragms in a housing define two vacuum chambers. A spring urges one diaphragm and an actuator rod extended, and the other diaphragm retracted. Vacuum in one chamber retracts the extended diaphragm and actuator rod to an intermediate position, and advances the retracted diaphragm. Vacuum added in the other chamber retracts both diaphragms and the rod as a unit to a fully retracted position.

4 Claims, 2 Drawing Sheets

DUAL DIAPHRAGM THREE POSITION ACTUATOR

This application is a continuation of application Ser. No. 941,986, filed Dec. 15, 1986 now abandoned.

BACKGROUND OF THE INVENTION

This invention relates to multiposition expansible chamber actuators and more particularly to a three position vacuum actuator useful for control operations such as shifting valves, fresh air dampers and the like on automotive equipment or other apparatus.

Vacuum motors or differential pressure expansible chambers motors are well known to those skilled in the art and it has been previously proposed to utilize multiposition vacuum actuators particularly in the automotive field. For the most part, previously known multiposition vacuum actuators have not received widespread acceptance because of their complex construction both as to piping, internal valving, requisite external valving and as to an actual physical construction, e.g., overall length, needed to accommodate components such as housing extensions which were used to obtain three-position actuation.

SUMMARY OF THE INVENTION

Accordingly, one of the primary objects of the present invention resides in the provision of a novel three position vacuum actuator having a minimum number of parts and being economical to manufacture.

Another object of the invention resides in the provision of a novel vacuum actuator improved over that shown in U.S. Pat. No. 3,613,513.

In a principal aspect, the invention resides in a dual diaphragm, multiposition vacuum actuator including dual diaphragms, a housing, an externally extending actuator rod, and internal urging and travel limiting means. The diaphragms and housing define two vacuum chambers. The urging means, in one form a spring, urges the diaphragms apart, with the rod and one diaphragm extended, and the other diaphragm retracted. Vacuum in one chamber draws the diaphragms together, advancing the retracted diaphragm, retracting the advanced diaphragm, and retracting the rod to an intermediate position. Vacuum in both chambers retract the diaphragms and rod as a unit, retracting the rod to a fully retracted position.

These and other objects, aspects and advantages of the invention are described in more detail in the description of the preferred embodiment of the invention, which follows.

BRIEF DESCRIPTION OF THE DRAWING

The accompanying drawing includes four figures. These figures are as follows.

DETAILED DESCRIPTION OF THE PREFERRED EMBODIMENT

Figure 1:
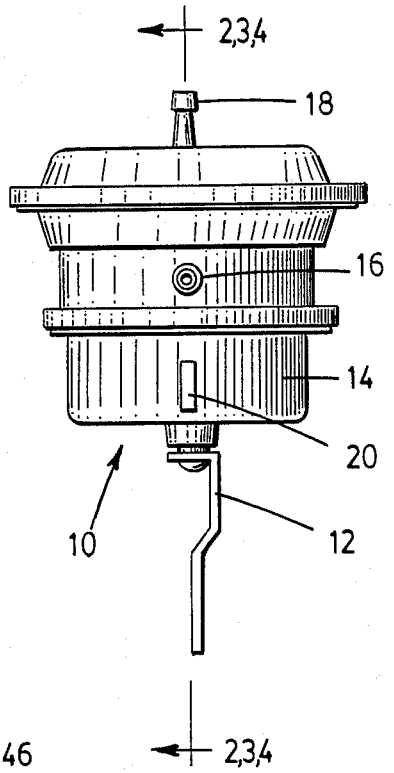
FIG. 1 is a side elevation view of a preferred embodiment of an actuator made in accordance with the present invention, illustrating the extended position of the actuator operator rod.

Referring to FIG. 1, a preferred embodiment of an actuator made according to the invention is an actuator 10. A rod 12 protrudes from an actuator housing 14. A pair of hose connectors 16, 18 define ports which lead into the housing 14. The housing is secured in a working location by rigid attachment to brackets such as 20, and hoses (not shown) are fitted to the hose connectors. The housing is oriented such that the rod is positioned to move along three desired positions. The rod is then attached to its intended workpiece.

Figure 2:
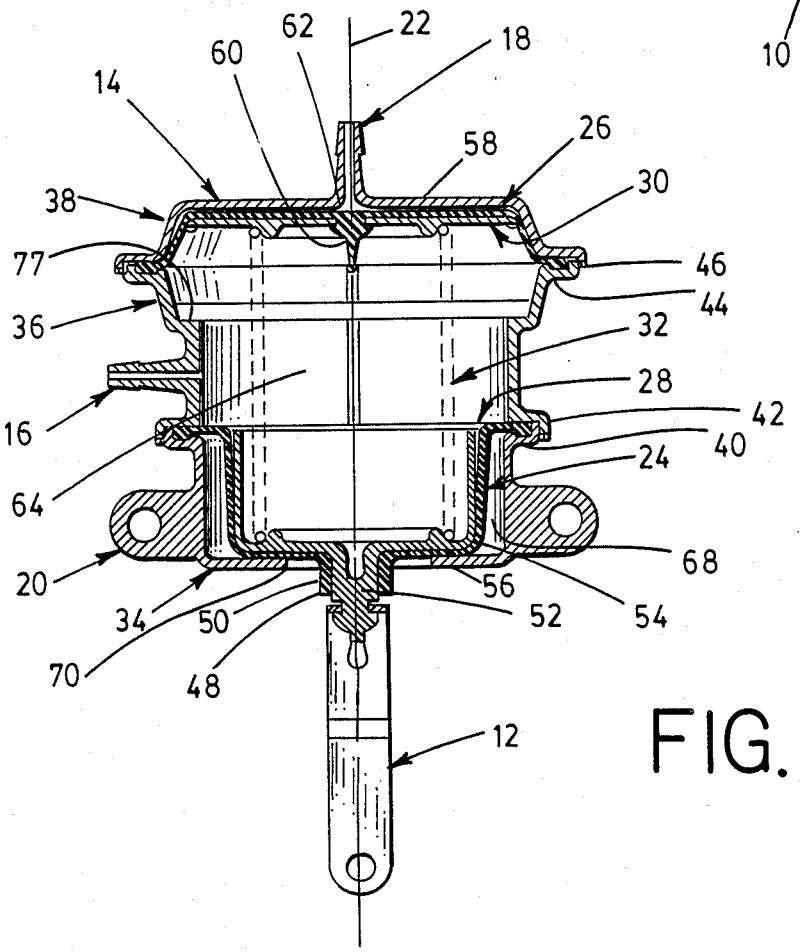
FIG. 2 is a cross-sectional view of the actuator of FIG. 1, taken along line 2, 3, 4—2, 3, 4 in FIG. 1, illustrating the extended actuator position as in FIG. 1.
Figure 3:
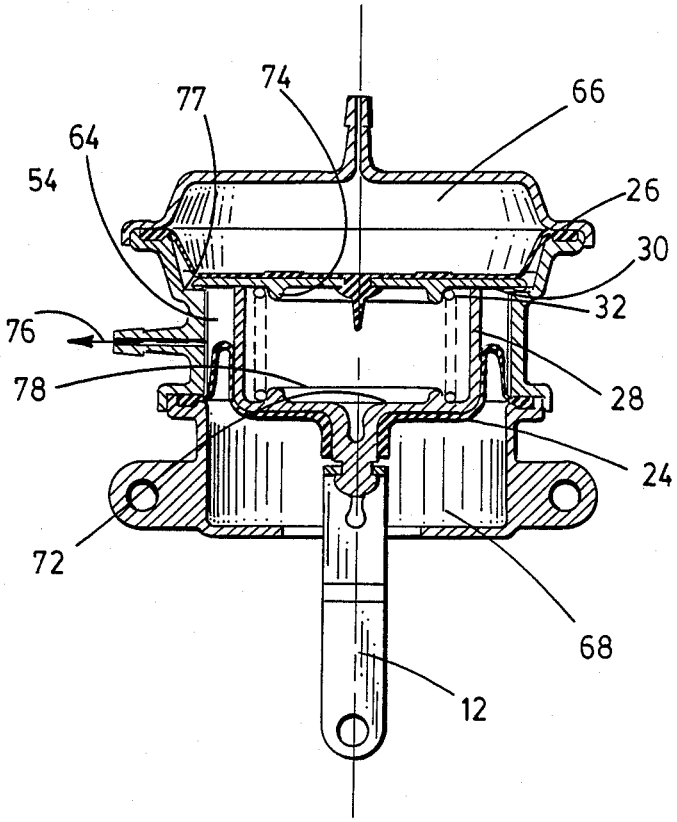
FIG. 3 is a cross-sectional view of the actuator of FIG. 1, taken along line 2, 3, 4—2, 3, 4 in FIG. 1, illustrating the intermediate actuator position.
Figure 4:
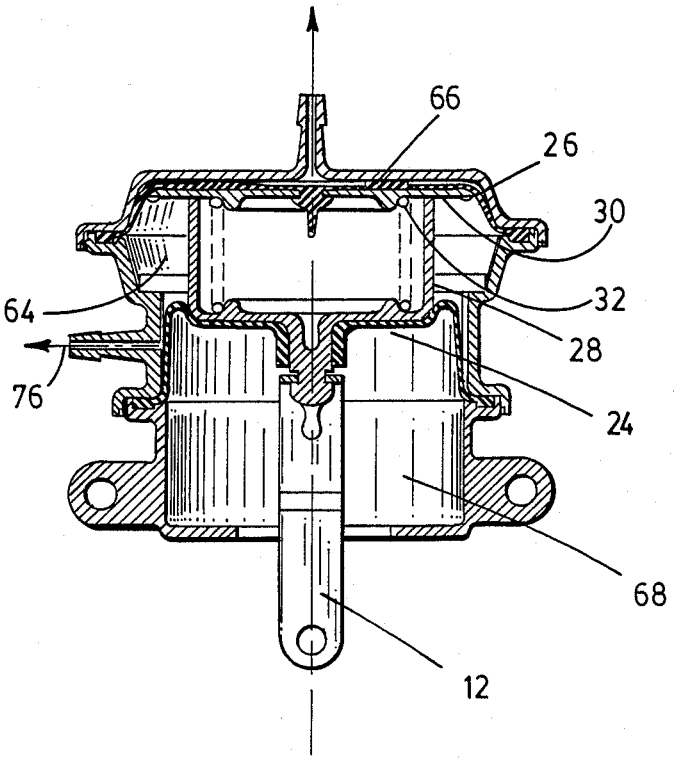
FIG. 4 is a cross-sectional view of the actuator of FIG. 1, taken along line 2, 3, 4—2, 3, 4 in FIG. 1, illustrating the retracted actuator position.

Comparing FIGS. 2, 3, and 4, the rod 12 is movable linearly along a first, extended actuator position (FIG. 2), a second, intermediate actuator position (FIG. 3), and a third, retracted actuator position (FIG. 4). Linear movement is along an axis of movement 22. The actuator 10 has three states of operation, each corresponding to an actuator position of the rod 12.

Referring to FIG. 2, the actuator 10 includes within the housing 14, two diaphragms 24, 26, a piston 28, a support plate 30 and a spring 32. The housing is formed of three housing members 34, 36, 38.

A first housing member 34 has a second housing member 36 attached thereto, along a pair of housing member rims 40, 42. The rim 40 defines a recess for the periphery of the first diaphragm 24, and the diaphragm 24 is secured to the housing between the rims 40, 42. The diaphragm 24 seals the joint between the housing members 34, 36.

The third housing member 38 is attached to the second housing member 36, opposite the first housing member 34. A pair of rims 44, 46 also include a recess, and the second diaphragm 26 is secured to the housing between the rims 44, 46. The second diaphragm 26 seals the joint between the housing members 36, 38.

The diaphragms 24, 26 are each formed of rubber or the like. The first diaphragm includes a central opening 48 within a central, annular portion 50. The annular portion 50 is fitted to a stem 52 on the piston 28. The first diaphragm 24 extends in a median portion from its periphery to its center. The median portion is flexible such that (a) the median portion accommodates and encircles the piston side wall 54, while the piston is adjacent the end wall 56 of the housing portions 34, as in FIG. 2 and (b) the median portion encircles only portions of the piston, as in FIGS. 3 and 4, while the median portion flexes to accommodate movement of the piston 28 through the housing to a position adjacent the end wall 58 of the housing portion 38.

The second diaphragm 26 includes a central button 60, which fits through a central opening 62 in the support plate 30. The button 60 holds the plate 30 to the diaphragm 26. The diaphragm 26 extends in a median portion from its periphery to its center. The median portion is flexible, such that the plate is movable from the end wall 58, as in FIG. 2, to within the housing portion 36, as in FIG. 3. The median portions of both diaphragms constitute annular, rolling lobes by which the described movement is accommodated.

The housing 14 and diaphragms 24, 26 cooperate to define three chambers within the housing 14. A first chamber 64 is defined between the diaphragms 24, 26. The chamber 64 is variable in volume, and collapsable when subjected to vacuum, as is a second chamber 66 (FIG. 3). The second chamber 66 is defined adjacent the diaphragm 26, opposite the diaphragm 24, between the diaphragm 26 and housing end wall 58. The port of connector 16 leads into the first chamber 64; the port of connector 18 leads into the second chamber 66. The housing member 36 is contoured internally to prevent diaphragm 24 from closing off port 16. Except as open through these ports, the chambers 66, 64 are sealed, and capable of maintaining vacuums applied at the ports.

The third chamber defined within the housing 14 is chamber 68, adjacent the first diaphragm 24, between the diaphragm 24 and housing end wall 56. The chamber 68 is open to the atmosphere through a large, central opening 70 in the end wall 56.

Referring to FIG. 3, for ease of following numbering, the spring 32 is located between the diaphragms 24, 26, and between the piston 28 and support plate 30. The spring 32 is a compressable coil spring. One end is retained in correct, centered position inside the side wall 54 of the piston 28 by a raised, annular spring retainer ring 78. The spring retainer ring 78 is located on the face wall 72 of the piston 28, opposite the diaphragm 24. The opposite end of the spring 32 is retained in correct, centered position by a second raised, annular spring retainer ring 74. The second spring retainer ring 74 is located on the support plate 30.

The spring 32 has a spring constant such that with all chambers at atmospheric or otherwise equal pressure, the spring 32 urges and pushes the diaphragms 24, 26 apart from each other. As in FIG. 2, the spring 32 urges the piston 28 and thereby the central portion of the diaphragm 24 toward the housing end wall 56. The diaphragm 24 is urged into contact with the end wall 56. The spring 32 also urges the support plate 30 and thereby the central portion of the diaphragm 26 away from the diaphragm 24, piston 28 and end wall 56, toward the end wall 58. The diaphragm 26 contacts the end wall 58, and the diaphragms 24, 26 are at maximum separation. Chamber 64 is at maximum volume, while chamber 66 is collapsed.

The piston stem 52 is attached to the rod 12, as by deformation of an opening in the rod 12 around the stem end. As a result of the position of the internal actuator components as described in their first state, the rod occupies its first, extended actuator position.

When vacuum is applied to the first chamber port 16, as represented by arrow 76, the first chamber 64 is evacuated while chamber 66 is vented to atmosphere. This vacuum counteracts the action of the spring 32. The pressure differential across the diaphragms (chambers 66, 68 are at atmospheric pressure) overcomes the force of the spring. The diaphragms are moved together, toward the positions of FIG. 3. The positions of FIG. 3 define the second state of the actuator 10.

In this second state, both diaphragms 24, 26 are moved to the middle of the housing 14, intermediate the end walls 56, 58. The second diaphragm 26 is drawn to a limit of travel of the support plate 30. This limit is a position of contact of the plate 30 with a stop. The stop is in the form of an annular ledge 77 in the second housing member 36.

The first diaphragm 24 is drawn to a position of contact of the piston 28 with the plate 30. The first diaphragm, the piston 28 and the rod 12 are retracted, while the diaphragm 26 and plate 30 are advanced. The rod 12 occupies its intermediate position. The spring 32 is collapsed.

Application of vacuum to the second chamber port evacuates the second chamber 66 while retaining vacuum 76 on port 16. The second diaphragm 26 then has vacuums along both sides and there is no differential pressure across diaphragm 26. The first diaphragm 24 is acted upon by atmospheric pressure within the chamber 68. As a result, the diaphragms 24, 26, piston 28, plate 30, spring 32 and rod 12 move as a unit to the third state of the actuator, as in FIG. 4. All such components are retracted in the third state. The diaphragm 26 and plate 30 are returned to the position of the first state. The rod 12 is retracted to its retracted position.

The actuator 10 thus constitutes a three position vacuum actuator. The rod and piston stem constitute one possible form of a means for transmitting motion of the internal elements of the actuator exteriorly of the actuator. The spring constitutes one possible form of an urging means, for urging the diaphragms as described and enabling their movement under vacuum as described. The ledge 77 constitutes one possible form of means for limiting travel of the second diaphragm 26. A greater size of the diaphragm 26 as compared to the diaphragm 24 assures movement of the diaphragm 26 to the ledge 77 upon evacuation of the first chamber 64.

The preferred embodiment and the invention are now described in such full, clear, concise and exact terms as to enable a person of skill in the art to make and use the same. Additional information concerning vacuum actuators is provided in U.S. Pat. No. 3,613,513, incorporated by reference.

To particularly point out and distinctly claim the subject matter regarded as invention, the following claims conclude this specification.

What is claimed is:

1. An improved dual diaphragm, multiposition vacuum actuator for selectively moving an actuator rod between an extended position, a middle position and a retracted position, the improved vacuum actuator comprising:

a housing having a rod end, a rear end and a side wall, with the rod end having an aperture therein;

a first diaphragm having its periphery secured to the housing and having a first effective area, the first diaphragm being disposed between the rod end and the rear end of the housing and being selectively movable within the housing between a first position where the first diaphragm is in substantial contact with the rod end of the housing, a second position where the first diaphragm is positioned a first predetermined distance away from the rod end of the housing, and a third position where the first diaphragm is positioned a second predetermined distance still further away from the rod end of the housing;

a second diaphragm having its periphery secured to the housing and having a second effective area that is greater than the first effective area of the first diaphragm, the second diaphragm being disposed between the rear end of the housing and the first diaphragm and being selectively movable within the housing between a first position where the second diaphragm is in substantial contact with the rear end of the housing and a second position where the second diaphragm is positioned a predetermined distance away from the rear end of the housing;

stop means for defining the second position of the second diaphragm and for preventing movement of the second diaphragm away from the rear end of the housing beyond its second position;

spring means disposed within the housing and between the first and second diaphragms for urging the first and second diaphragms apart and toward their respective first positions;

the first diaphragm, the second diaphragm, and housing defining a middle, collapsible chamber between the first and second diaphragms; the second diaphragm and housing defining a rear, collapsible chamber between the second diaphragm and the read end of the housing; and the first diaphragm and the housing defining a rod end, collapsible chamber between the first diaphragm and the rod end of the housing;

an actuator rod having a first end and second end, and being secured, at its first end, to the first diaphragm so that the second end of the actuator road extends through the aperture in the rod end of the housing to the exterior of the housing, with the cross-sectional area of the aperture in the rod end of the housing being greater than the cross-sectional area of the actuator rod so that the interior of the rod end chamber is in communication with atmospheric pressure; and the housing further defining a first port into the middle chamber and a second port into the rear chamber so that each of the middle chamber and the rear chamber may be selectively subjected to vacuum or to atmospheric pressure; with the actuator rod being in its extend position and the first and second diaphragms being in their first positions, under the urging of the spring means, when the middle and rear chambers are subject to atmospheric pressure; with the actuator rod being in its middle position and the first and second diaphragms being in their second positions when the middle chamber is subject to vacuum and the rear chamber is subject to atmospheric pressure; and with the actuator rod being in its retracted position, the first diaphragm being in its third position and the second diaphragm being in its first position when the middle and rear chambers are both subject to vacuum.

2. The vacuum actuator as in claim 1, wherein a piston is connected with and is carried by the first diaphragm so that piston is disposed in the middle chamber and faces the second diaphragm; wherein a support plate is connected with and is carried by the second diaphragm so that the support plate is disposed in the middle chamber and faces the piston; wherein the piston and support plate are in contact when the first diaphragm is in its second position and the second diaphragm is in its second position and when the first diaphragm is in its third position and the second diaphragm is in its first position.

3. The vacuum actuator as in claim 2 wherein the spring means is a coil spring; wherein one end of the coil spring abuts the piston and the other end of the coil spring abuts the support plate; wherein the piston includes an annular side wall that extends toward the support; and wherein the coil spring is disposed within the annular side wall of the piston.

4. The vacuum actuator as in claim 1 wherein the spring means is a coil spring.

* * * * *